US010369834B2

(12) United States Patent
Landers

(10) Patent No.: US 10,369,834 B2
(45) Date of Patent: Aug. 6, 2019

(54) CRAYON WRAPPING SYSTEM

(71) Applicant: Jacob Landers, Orlando, FL (US)

(72) Inventor: Jacob Landers, Orlando, FL (US)

( * ) Notice: Subject to any disclaimer, the term of this patent is extended or adjusted under 35 U.S.C. 154(b) by 103 days.

(21) Appl. No.: 15/792,338

(22) Filed: Oct. 24, 2017

(65) Prior Publication Data

US 2019/0118572 A1 Apr. 25, 2019

(51) Int. Cl.
*B43K 19/14* (2006.01)

(52) U.S. Cl.
CPC ..... *B43K 19/145* (2013.01)

(58) Field of Classification Search
CPC ..... B43K 19/14–145
See application file for complete search history.

(56) References Cited

U.S. PATENT DOCUMENTS 461,911 A * 10/1891 Blaisdell ..... B43K 19/145 401/97
554,212 A * 2/1896 Boman ..... B43K 19/145 401/97
609,910 A * 8/1898 Seaman ..... B43K 19/145 401/97
620,051 A * 2/1899 Rakestraw ..... B43K 19/145 401/97
674,851 A * 5/1901 Bremer ..... B43K 19/145 401/97
845,320 A * 2/1907 Smith ..... B43K 19/145 401/97
1,131,786 A * 3/1915 Morrison ..... B43K 29/007 156/247
1,233,815 A * 7/1917 Smith ..... B43K 19/145 401/97
1,294,802 A * 2/1919 Hess ..... B43K 19/145 401/97
1,327,236 A * 1/1920 Hess ..... B43K 19/145 401/97
1,436,754 A * 11/1922 Chadwick ..... B65D 85/78 229/202
1,756,953 A * 5/1930 O'Sullivan ..... B43K 19/145 401/50
1,761,407 A * 6/1930 O'Sullivan ..... B43K 19/145 401/97
1,945,255 A * 1/1934 Camagni ..... A45D 40/16 425/DIG. 32
2,277,992 A * 3/1942 Oxley ..... B43K 19/14 401/96
2,296,455 A 9/1942 Schroeder
2,464,436 A * 3/1949 Cox ..... B43K 19/00 15/210.1
2,465,597 A 3/1949 Marsh
2,646,879 A * 7/1953 Carstensen ..... B43K 19/14 401/50

(Continued)

FOREIGN PATENT DOCUMENTS

WO WO9964253 12/1999

*Primary Examiner* — David J Walczak
*Assistant Examiner* — Randall A Gruby

(57) ABSTRACT

A crayon wrapping system for exposing a crayon that becomes shorter from usage includes a crayon that may be manipulated for coloring. A wrapper is wrapped around the crayon such that the wrapper forms a helical coil on the crayon. Moreover, the wrapper is selectively peeled away from the crayon as the crayon becomes shorter from usage.

6 Claims, 3 Drawing Sheets

(56) References Cited

U.S. PATENT DOCUMENTS

| | | | | | |
|---|---|---|---|---|---|
| 2,852,179 | A | * | 9/1958 | Bieler | B65D 75/5888 229/101.1 |
| 3,010,862 | A | | 11/1961 | Basche | |
| 4,019,822 | A | * | 4/1977 | Matsumoto | B43K 19/00 401/96 |
| 4,245,919 | A | * | 1/1981 | Kinsell, Jr. | B05C 17/00 401/97 |
| 4,779,738 | A | * | 10/1988 | Akutsu | B65D 3/266 220/270 |
| 5,042,666 | A | * | 8/1991 | Dolenc | A47G 21/001 229/101.1 |
| 5,112,151 | A | | 5/1992 | Collignon | |
| 8,944,715 | B2 | * | 2/2015 | Yoder | B43K 5/005 401/131 |
| 10,059,142 | B2 | * | 8/2018 | Thies | A45D 40/20 |

* cited by examiner

CRAYON WRAPPING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention

The disclosure relates to wrapping devices and more particularly pertains to a new wrapping device for exposing a crayon that becomes shorter from usage.

(2) Description of Related Art including information disclosed under 37 CFR 1.97 and 1.98.

The prior art relates to wrapping devices.

BRIEF SUMMARY OF THE INVENTION

An embodiment of the disclosure meets the needs presented above by generally comprising a crayon that may be manipulated for coloring. A wrapper is wrapped around the crayon such that the wrapper forms a helical coil on the crayon. Moreover, the wrapper is selectively peeled away from the crayon as the crayon becomes shorter from usage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
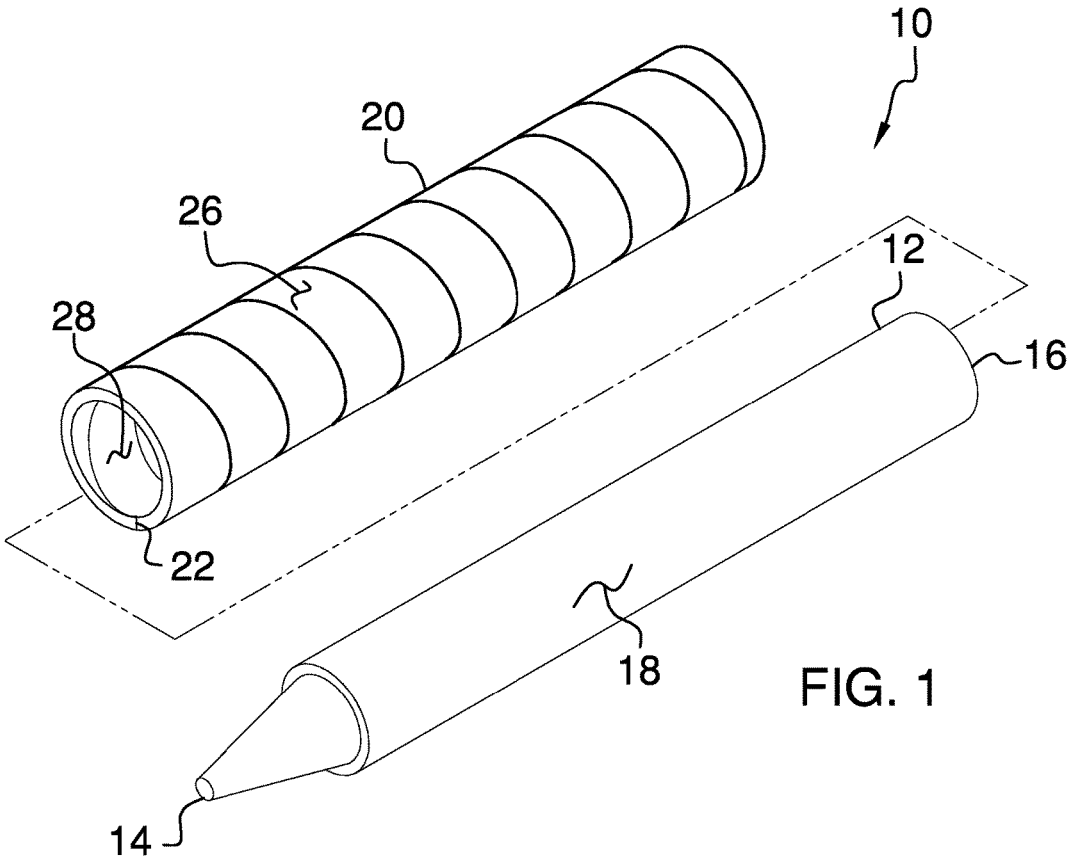
FIG. 1 is an exploded perspective view of a crayon wrapping system according to an embodiment of the disclosure.
Figure 2:
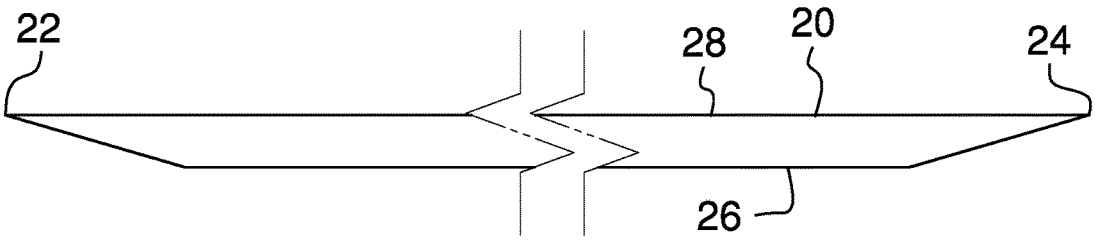
FIG. 2 is a right side view of wrapper an embodiment of the disclosure.
Figure 3:
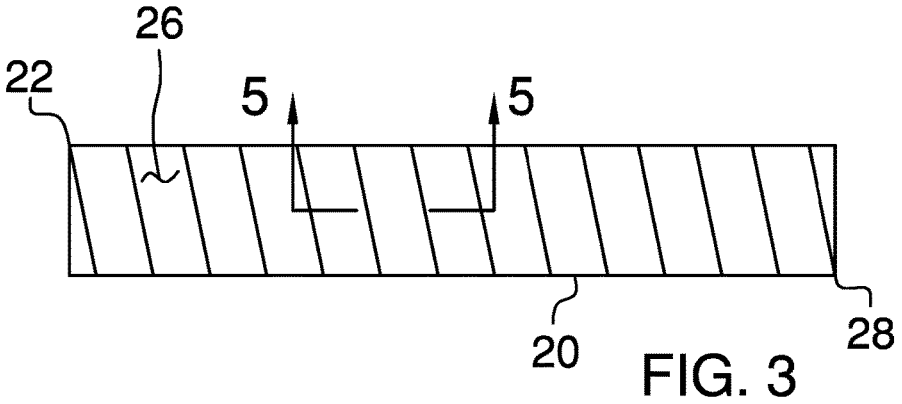
FIG. 3 is a bottom view of wrapper of an embodiment of the disclosure.
Figure 4:
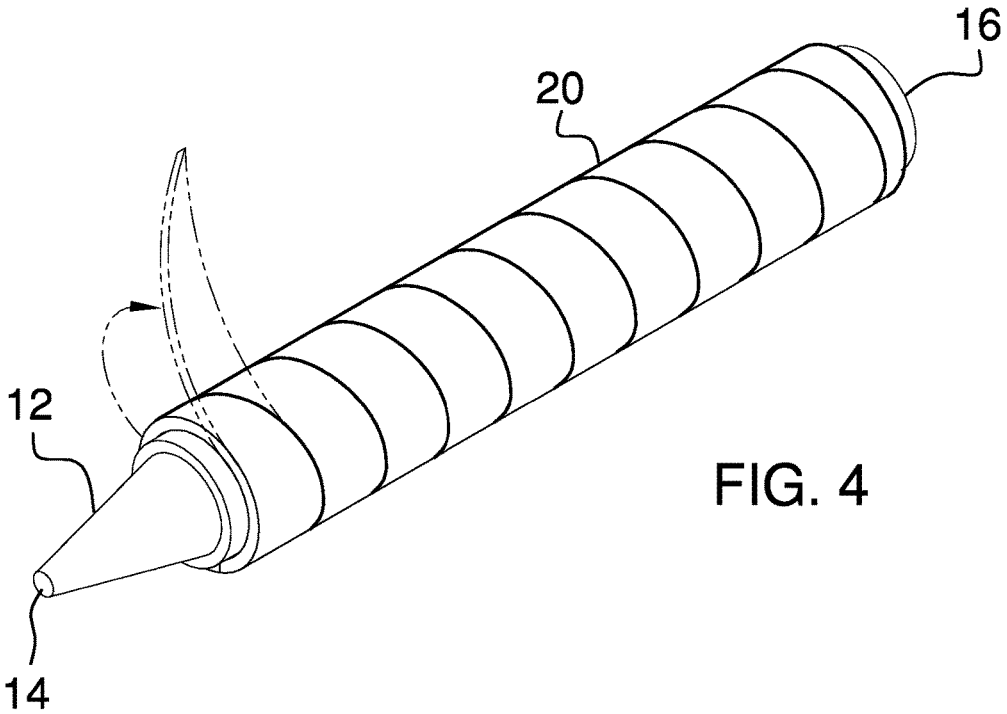
FIG. 4 is a perspective view of an embodiment of the disclosure.
Figure 5:
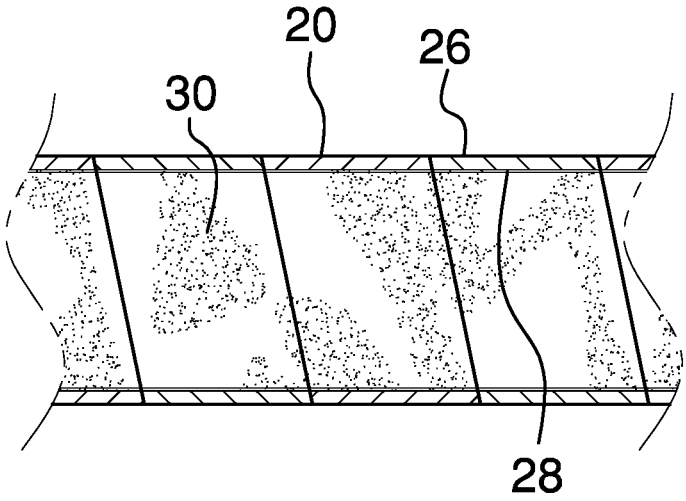
FIG. 5 is a cross sectional view taken along line 5-5 of FIG. 3 of an embodiment of the disclosure.

With reference now to the drawings, and in particular to FIGS. 1 through 5 thereof, a new wrapping device embodying the principles and concepts of an embodiment of the disclosure and generally designated by the reference numeral 10 will be described.

As best illustrated in FIGS. 1 through 5, the crayon wrapping system 10 generally comprises a crayon 12 that may be manipulated for coloring. The crayon 12 has a first end 14, a second end 16 and an outer surface 18 extending therebetween. The outer surface 18 is continuous such that the crayon 12 has a cylindrical shape. The crayon 12 may be a wax crayon 12 as manufactured by Crayola Corporation, 1100 Church Lane, Easton, Pa., 18044-0431.

A wrapper 20 is provided and the wrapper 20 is wrapped around the crayon 12 such that the wrapper 20 forms a helical coil around the crayon 12. The wrapper 20 may be comprised of a tearable material such as paper or the like. In this way the wrapper 20 may be selectively torn off when the wrapper 20 is peeled away from the crayon 12. The wrapper 20 is selectively peeled away from the crayon 12 as the crayon 12 becomes shorter from usage. The wrapper 20 has a first end 22, a second end 24, a first surface 26 extending between the first end 14 and second end 16 and a second surface 28 extending between the first end 14 and the second end 16. Moreover, the wrapper 20 is elongated between the first end 14 and the second end 16.

An adhesive layer 30 is positioned on the second surface 28 of the wrapper 20. The adhesive layer 30 adhesively engages the outer surface 18 of the crayon 12 to releasably retain the wrapper 20 on the crayon 12. The wrapper 20 may be comprised of a material that has a shear strength of approximately 5.0 grams. Additionally, the adhesive layer 30 may be comprised of a non-residual adhesive with a bonding strength of less than 5.0 grams. In this way the adhesive layer 30 releases the crayon 12 without tearing the wrapper 20 when the wrapper 20 is selectively unwrapped from the crayon 12.

Each of the first end 22 and the second end 24 of the wrapper 20 slopes downwardly between the first surface 26 and the second surface 28. Additionally, each of the first end 22 and the second end 24 of the wrapper 20 tapers to a point. The wrapper 20 is wrapped around the outer surface 18 of the crayon 12 such that the wrapper 20 forms a helical coil extending between the first end 14 and the second end 16 of the crayon 12. The first end 14 of the wrapper 20 is spaced from the first end 14 of the crayon 12 and the second end 16 of the wrapper 20 is aligned with the second end 16 of the crayon 12. The wrapper 20 is selectively peeled away from the crayon 12 starting from the first end 14 of the crayon 12.

In this way the first end 14 of the crayon 12 may be continuously exposed for coloring.

In use, the crayon 12 is manipulated for coloring. The first end 22 of the wrapper 20 is gripped thereby facilitating the wrapper 20 to be peeled away from the crayon 12 when the crayon 12 becomes shortened from usage. In this way the first end 14 of the crayon 12 may be continuously exposed for coloring. Additionally, the helical coil formed by the wrapper 20 ensures that the wrapper 20 may be precisely peeled away from the crayon 12 to expose the first end 14 of the crayon 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A crayon wrapping system being selectively peeled away from a crayon as the crayon becomes shorter from use, said system comprising:

a crayon being configured to be manipulated for coloring; and a wrapper being wrapped around said crayon such that said wrapper forms a helical coil on said crayon, said wrapper being selectively peeled away from said crayon as the crayon becomes shorter from usage;

wherein said wrapper has a first end, a second end, a first surface extending between said first end and second end, and a second surface extending between said first end and said second end, each of said first end and said second end sloping downwardly between said first surface and said second surface, said wrapper being elongated between said first end and said second end.

2. The system according to claim 1, further comprising said crayon has a first end, a second end and an outer surface extending therebetween, said outer surface being continuous such that said crayon has a cylindrical shape.

3. The system according to claim 1, wherein:

said crayon has a first end, a second end and an outer surface extending therebetween, said outer surface being continuous such that said crayon has a cylindrical shape; and said wrapper is wrapped around said outer surface of said crayon such that said wrapper forms a helical coil extending between said first end and said second end of said crayon, said first end of said wrapper being spaced from said first end of said crayon, said second end of said wrapper being aligned with said second end of said crayon.

4. The system according to claim 3, wherein said wrapper is selectively peeled away from said crayon starting from said first end of said crayon thereby facilitating said first end of said crayon to be continuously exposed for coloring.

5. The system according to claim 3, further comprising an adhesive layer being positioned on said second surface of said wrapper such that said adhesive layer adhesively engages said outer surface of said crayon to releasably retain said wrapper on said crayon.

6. A crayon wrapping system being selectively peeled away from a crayon as the crayon becomes shorter from use, said system comprising:

a crayon being configured to be manipulated for coloring, said crayon having a first end, a second end and an outer surface extending therebetween, said outer surface being continuous such that said crayon has a cylindrical shape;

a wrapper being wrapped around said crayon such that said wrapper forms a helical coil around said crayon, said wrapper being selectively peeled away from said crayon as the crayon becomes shorter from usage, said wrapper having a first end, a second end, a first surface extending between said first end and second end, and a second surface extending between said first end and said second end, said wrapper being elongated between said first end and said second end, each of said first end and said second end sloping downwardly between said first surface and said second surface, said wrapper being wrapped around said outer surface of said crayon such that said wrapper forms a helical coil extending between said first end and said second end of said crayon, said first end of said wrapper being spaced from said first end of said crayon, said second end of said wrapper being aligned with said second end of said crayon, said wrapper being selectively peeled away from said crayon starting from said first end of said crayon thereby facilitating said first end of said crayon to be continuously exposed for coloring; and an adhesive layer being positioned on said second surface of said wrapper such that said adhesive layer adhesively engages said outer surface of said crayon to releasably retain said wrapper on said crayon.

* * * * *